US007150770B2

(12) United States Patent
Keipert et al.

(10) Patent No.: US 7,150,770 B2
(45) **Date of Patent: *Dec. 19, 2006**

(54) COATED ABRASIVE ARTICLE WITH TIE LAYER, AND METHOD OF MAKING AND USING THE SAME

(75) Inventors: Steven J. Keipert, Somerset, WI (US); Ernest L. Thurber, Woodbury, MN (US); Don H. Kincaid, Hudson, WI (US); Ronald D. Provow, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/871,455

(22) Filed: Jun. 18, 2004

(65) Prior Publication Data

US 2005/0279028 A1 Dec. 22, 2005

(51) Int. Cl.

| | |
|---|---|
| ***B24D 11/00*** | (2006.01) |
| ***B24D 17/00*** | (2006.01) |
| ***B24D 18/00*** | (2006.01) |
| ***B24D 3/00*** | (2006.01) |

(52) U.S. Cl. ..... 51/298; 51/307; 51/308; 51/309; 51/295; 451/28; 451/526; 451/539

(58) Field of Classification Search ..... 51/298, 51/307, 308, 309, 295; 451/28, 526, 539
See application file for complete search history.

(56) References Cited

U.S. PATENT DOCUMENTS

| | | | |
|---|---|---|---|
| 3,225,013 | A | 12/1965 | Fram |
| 4,314,827 | A | 2/1982 | Leitheiser et al. |
| 4,518,397 | A | 5/1985 | Leitheiser et al. |
| 4,525,232 | A | 6/1985 | Rooney et al. |
| 4,588,419 | A | 5/1986 | Caul et al. |
| 4,598,269 | A | 7/1986 | Penney |
| 4,623,364 | A | 11/1986 | Cottringer et al. |
| 4,652,275 | A | 3/1987 | Bloecher et al. |
| 4,734,104 | A | 3/1988 | Broberg |
| 4,737,163 | A | 4/1988 | Larkey |
| 4,744,802 | A | 5/1988 | Schwabel |
| 4,749,617 | A | 6/1988 | Canty |
| 4,751,138 | A | 6/1988 | Tumey et al. |
| 4,770,671 | A | 9/1988 | Monroe et al. |
| 4,799,939 | A | 1/1989 | Bloecher et al. |
| 4,822,829 | A | 4/1989 | Müller et al. |
| 4,881,951 | A | 11/1989 | Wood et al. |
| 4,927,431 | A | 5/1990 | Buchanan et al. |
| 4,939,008 | A | 7/1990 | Kemski |

(Continued)

FOREIGN PATENT DOCUMENTS

| | | |
|---|---|---|
| EP | 0 590 665 A1 | 4/1994 |

(Continued)

OTHER PUBLICATIONS

Thurber et al., "Composition, Treated Backing, and Coated Abrasive Articles Containing the Same", U.S. Appl. No. 10/655,195, filed Sep. 4, 2003.

(Continued)

*Primary Examiner*—Michael A. Marcheschi

(57) ABSTRACT

Coated abrasive articles have a tie layer that is preparable by at least partially polymerizing an isotropic polymerizable composition comprising a polyfunctional aziridine, an acidic free-radically polymerizable monomer, and an oligomer having at least two pendant free-radically polymerizable groups, wherein homopolymerization of the oligomer results in a polymer having a glass transition temperature of less than 50 degrees Celsius.

37 Claims, 1 Drawing Sheet

U.S. PATENT DOCUMENTS 5,011,508 A 4/1991 Wald et al.
5,078,753 A 1/1992 Broberg et al.
5,090,968 A 2/1992 Pellow
5,108,463 A 4/1992 Buchanan
5,137,542 A 8/1992 Buchanan et al.
5,139,978 A 8/1992 Wood
5,152,917 A 10/1992 Pieper et al.
5,201,916 A 4/1993 Berg et al.
5,203,884 A 4/1993 Buchanan et al.
5,227,104 A 7/1993 Bauer
5,304,223 A 4/1994 Pieper et al.
5,328,716 A 7/1994 Buchanan
5,366,523 A 11/1994 Rowenhorst et al.
5,378,251 A 1/1995 Culler et al.
5,417,726 A 5/1995 Stout et al.
5,426,134 A 6/1995 Rheinberger et al.
5,429,647 A 7/1995 Larmie
5,436,063 A 7/1995 Follett et al.
5,490,878 A 2/1996 Peterson et al.
5,492,550 A 2/1996 Krishnan et al.
5,496,386 A 3/1996 Broberg et al.
5,498,269 A 3/1996 Larmie
5,505,747 A 4/1996 Chesley et al.
5,520,711 A 5/1996 Helmin
5,534,391 A 7/1996 Wang
5,549,962 A 8/1996 Holmes et al.
5,551,961 A 9/1996 Engen et al.
5,551,963 A 9/1996 Larmie
5,556,437 A 9/1996 Lee et al.
5,560,753 A 10/1996 Schnabel et al.
5,565,011 A 10/1996 Follett et al.
5,573,619 A 11/1996 Benedict et al.
5,578,095 A 11/1996 Bland et al.
5,609,706 A 3/1997 Benedict et al.
5,611,825 A 3/1997 Engen et al.
5,643,669 A 7/1997 Tsuei
5,667,541 A 9/1997 Klun et al.
5,672,186 A 9/1997 Chesley et al.
5,700,302 A 12/1997 Stoetzel et al.
5,714,259 A 2/1998 Holmes et al.
5,754,338 A 5/1998 Wilson et al.
5,784,197 A 7/1998 Frey et al.
5,851,247 A 12/1998 Stoetzel et al.
5,853,632 A 12/1998 Bunke et al.
5,882,796 A 3/1999 Wilson et al.
5,913,716 A 6/1999 Mucci et al.
5,932,350 A 8/1999 Lauer et al.
5,942,015 A 8/1999 Culler et al.
5,954,844 A 9/1999 Law et al.
5,961,674 A 10/1999 Gagliardi et al.
5,975,988 A 11/1999 Christianson
5,989,111 A 11/1999 Lamphere et al.
6,059,850 A 5/2000 Lise et al.
6,139,594 A 10/2000 Kincaid et al.
6,200,666 B1 3/2001 Christian et al.
6,217,432 B1 4/2001 Woo
6,234,875 B1 5/2001 Pendergrass, Jr.
6,239,049 B1 5/2001 Follensbee et al.
6,248,815 B1 6/2001 Papsin et al.
6,261,682 B1 7/2001 Law
6,475,253 B1 11/2002 Culler et al.
6,645,624 B1 11/2003 Adefris et al.
2002/0016226 A1 2/2002 Jin et al.
2002/0026752 A1 3/2002 Culler et al.
2004/0018802 A1 1/2004 Welygan et al.
2004/0029511 A1 2/2004 Kincaid et al.

FOREIGN PATENT DOCUMENTS

WO WO 00/37569 6/2000
WO WO 2004/025016 A1 3/2004

OTHER PUBLICATIONS

Collins et al., "Sructured Abrasive with Parabolic Sides", U.S. Appl. No. 10/668,736, filed Sep. 23, 2003.
Keipert et al., "Polymerizable Composition and Articles Therefrom", U.S. Appl. No. 10/871,451, filed Jun. 18, 2004.
Keipert et al., "Coated Abrasive Article with Composite Tie Layer, and Method of Making and Using the Same", U.S. Appl. No. 10/871,486, filed Jun. 18, 2004.
Oligomer Selection Guide, Sartomer Company Inc., Exton, Pennsylvania, 1997, 18 pages.
Application Bulletin, "Glass Transition Temperatures of Sartomer Products", Sartomer Products, Sartomer Company Inc., Exton, Pennsylvania, Oct. 1999, 5 pages.

COATED ABRASIVE ARTICLE WITH TIE LAYER, AND METHOD OF MAKING AND USING THE SAME

BACKGROUND

In general, coated abrasive articles have abrasive particles secured to a backing. More typically, coated abrasive articles comprise a backing having two major opposed surfaces and an abrasive layer secured to one of the major surfaces. The abrasive layer is typically comprised of abrasive particles and a binder, wherein the binder serves to secure the abrasive particles to the backing.

One common type of coated abrasive article has an abrasive layer which comprises a make layer, a size layer, and abrasive particles. In making such a coated abrasive article, a make layer comprising a first binder precursor is applied to a major surface of the backing. Abrasive particles are then at least partially embedded into the make layer (e.g., by electrostatic coating), and the first binder precursor is cured (i.e., crosslinked) to secure the particles to the make layer. A size layer comprising a second binder precursor is then applied over the make layer and abrasive particles, followed by curing of the binder precursors.

Another common type of coated abrasive article comprises an abrasive layer secured to a major surface of a backing, wherein the abrasive layer is provided by applying a slurry comprised of binder precursor and abrasive particles onto a major surface of a backing, and then curing the binder precursor.

In another aspect, coated abrasive articles may further comprise a supersize layer covering the abrasive layer. The supersize layer typically includes grinding aids and/or anti-loading materials.

Optionally, backings used in coated abrasive articles may be treated with one or more applied coatings. Examples of typical backing treatments are a backsize layer (i.e., a coating on the major surface of the backing opposite the abrasive layer), a presize layer or a tie layer (i.e., a coating on the backing disposed between the abrasive layer and the backing), and/or a saturant that saturates the backing. A subsize is similar to a saturant, except that it is applied to a previously treated backing.

However, depending on the particular choice of abrasive layer and backing (treated or untreated), the abrasive layer may partially separate from the backing during abrading resulting in the release of abrasive particles. This phenomenon is known in the abrasive art as "shelling". In most cases, shelling is undesirable because it results in a loss of performance.

In one approach, a tie layer disposed between the backing and the abrasive layer has been used to address the problem of shelling in some coated abrasive articles.

Yet, despite such advances, there remains a continuing need for new materials and methods that can reduce the problem of shelling in coated abrasive articles.

SUMMARY

In one aspect, the present invention provides a coated abrasive article comprising a backing having a major surface, a tie layer secured to at least a portion of the major surface, an abrasive layer secured to at least a portion of the tie layer, the abrasive layer comprising abrasive particles and at least one binder resin, wherein the tie layer is preparable by at least partially polymerizing an isotropic polymerizable composition comprising at least one polyfunctional aziridine, at least one acidic free-radically polymerizable monomer, and at least one oligomer having at least two pendant free-radically polymerizable groups, wherein homopolymerization of the oligomer results in a polymer having a glass transition temperature of less than 50 degrees Celsius.

In some embodiments, the abrasive layer comprises a make layer comprising a first binder resin, abrasive particles embedded in the make layer, and a size layer comprising a second binder resin secured to the make layer and abrasive particles.

In some embodiments, the abrasive particles are dispersed in the binder resin.

In another aspect, the present invention provides a method of making a coated abrasive article comprising:

disposing a tie layer precursor on at least a portion of a backing, the tie layer precursor comprising an isotropic composition comprising at least one polyfunctional aziridine, at least one acidic free-radically polymerizable monomer, and at least one oligomer having at least two pendant free-radically polymerizable groups, wherein homopolymerization of the oligomer results in a polymer having a glass transition temperature of less than 50 degrees Celsius; and at least partially polymerizing the tie layer precursor;

disposing a polymerizable make resin precursor on the at least partially polymerized tie layer precursor;

at least partially embedding abrasive particles in the make resin precursor; and at least partially polymerizing the make resin precursor.

In yet another aspect, the present invention provides a method of making a coated abrasive article comprising:

disposing a tie layer precursor on at least a portion of a backing, the tie layer precursor comprising an isotropic composition comprising at least one polyfunctional aziridine, at least one acidic free-radically polymerizable monomer, and at least one oligomer having at least two pendant free-radically polymerizable groups, wherein homopolymerization of the oligomer results in a polymer having a glass transition temperature of less than 50 degrees Celsius; and at least partially polymerizing the tie layer precursor;

disposing a slurry comprising polymerizable binder precursor and abrasive particles on the at least partially polymerized tie layer precursor; and at least partially polymerizing the binder precursor.

Coated abrasive articles according to the present invention are typically useful for abrading a workpiece, and may exhibit low levels of shelling during abrading processes.

As used herein, the term "(meth)acryl" includes both "acryl" and "methacryl".

DETAILED DESCRIPTION

Figure 1:
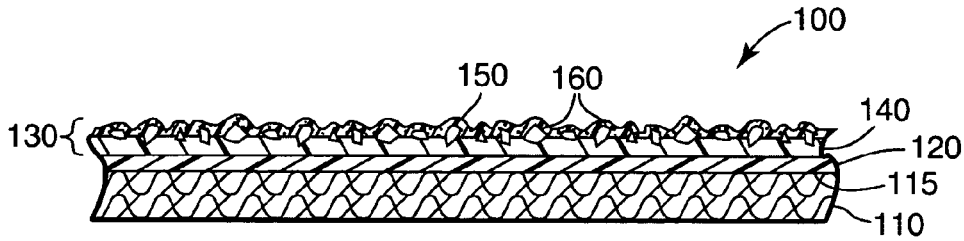
FIG. 1 is a cross-sectional view of an exemplary coated abrasive article.

Coated abrasive articles according to present invention comprise a backing having a major surface, a tie layer secured to at least a portion of the major surface, and an abrasive layer secured to at least a portion of the tie layer Suitable backings include those known in the art for making coated abrasive articles. Typically, the backing has two opposed major surfaces. The thickness of the backing generally ranges from about 0.02 to about 5 millimeters, desirably from about 0.05 to about 2.5 millimeters, and more desirably from about 0.1 to about 0.4 millimeter, although thicknesses outside of these ranges may also be useful.

The backing may be flexible or rigid, and may be made of any number of various materials including those conventionally used as backings in the manufacture of coated abrasives. Examples include paper, fabric, film, polymeric foam, vulcanized fiber, woven and nonwoven materials, combinations of two or more of these materials. The backing may also be a laminate of two materials (e.g., paper/film, cloth/paper, film/cloth).

Exemplary flexible backings include polymeric film (including primed films) such as polyolefin film (e.g., polypropylene including biaxially oriented polypropylene, polyester film, polyamide film, cellulose ester film), metal foil, mesh, scrim, foam (e.g., natural sponge material or polyurethane foam), cloth (e.g., cloth made from fibers or yarns comprising polyester, nylon, silk, cotton, and/or rayon), paper, vulcanized paper, vulcanized fiber, nonwoven materials, and combinations thereof. Cloth backings may be woven or stitch bonded.

The backing may be a fibrous reinforced thermoplastic such as described, for example, as described, for example, in U.S. Pat. No. 5,417,726 (Stout et al.), or an endless spliceless belt, for example, as described, for example, in U.S. Pat. No. 5,573,619 (Benedict et al.), the disclosures of which are incorporated herein by reference. Likewise, the backing may be a polymeric substrate having hooking stems projecting therefrom such as that described, for example, in U.S. Pat. No. 5,505,747 (Chesley et al.), the disclosure of which is incorporated herein by reference. Similarly, the backing may be a loop fabric such as that described, for example, in U.S. Pat. No. 5,565,011 (Follett et al.), the disclosure of which is incorporated herein by reference.

Exemplary rigid backings include metal plates, and ceramic plates. Another example of a suitable rigid backing is described, for example, in U.S. Pat. No. 5,417,726 (Stout et al.), the disclosure of which is incorporated herein by reference.

The backing may be a treated backing having one or more treatments applied thereto such as, for example, a presize, a backsize, a subsize, and/or a saturant. Additional details regarding backing treatments can be found in, for example, U.S. Pat. No. 5,108,463 (Buchanan et al.); U.S. Pat. No. 5,137,542 (Buchanan et al.); U.S. Pat. No. 5,328,716 (Buchanan); and U.S. Pat. No. 5,560,753 (Buchanan et al.), the disclosures of which are incorporated herein by reference.

The tie layer is preparable by at least partially polymerizing a tie layer precursor, which is an isotropic polymerizable composition comprising a polyfunctional aziridine, an acidic free-radically polymerizable monomer, and an oligomer having at least two pendant free-radically polymerizable groups, wherein homopolymerization of the oligomer results in a polymer having a glass transition temperature of less than 50 degrees Celsius.

As used herein, the term "polyfunctional aziridine" refers to a species having a plurality of aziridinyl groups. Suitable polyfunctional aziridines include, for example, those disclosed in U.S. Pat. No. 3,225,013 (Fram); U.S. Pat. No. 4,749,617 (Canty); and U.S. Pat. No. 5,534,391 (Wang), the disclosures of which are incorporated herein by reference. Specific examples include trimethylolpropane tris[3-aziridinyl propionate]; trimethylolpropane tris[3-(2-methylaziridinyl)propionate]; trimethylolpropane tris[2-aziridinylbutyrate]; tris(1-aziridinyl)phosphine oxide; tris(2-methyl-1-aziridinyl)phosphine oxide; pentaerythritol tris[3-(1-aziridinyl)propionate]; and pentaerythritol tetrakis[3-(1-aziridinyl)propionate]. Combinations of more than one polyfunctional aziridine may also be used.

Commercially available polyfunctional aziridines include those available under the trade designations "XAMA-2" (believed to be trimethylolpropane tris[3-(2-methylaziridinyl)propanoate]) and "XAMA-7" (believed to be pentaerythritol tris(beta-(N-aziridinyl)propionate)) from EIT, Inc. Corporation, Lake Wylie, S.C.; "HYDROFLEX XR2990" (believed to be trimethylolpropane tris[3-(2-methylaziridinyl)propanoate]) from H.B. Fuller Co., Vadnais Heights, Minn.; and "NEOCRYL CX-100" (believed to be trimethylolpropane tris[3-(2-methylaziridinyl)-propanoate]) from Zeneca Resins, Wilmington, Mass.

The amount of polyfunctional aziridine incorporated into the tie layer precursor is generally in a range of from at least 0.5, 1, or 2 percent by weight up to and including 4, 6, 8, or even 10 percent by weight, or more, based on the total weight of polyfunctional aziridine, acidic free-radically polymerizable monomer, and oligomer having at least two pendant free-radically polymerizable groups.

The acidic free-radically polymerizable monomer has both an acidic group and a group (e.g., a (meth)acryl group) that is free-radically polymerizable. The acidic group may be, for example, carbon-, sulfur-, or phosphorus-based, and may be the free acid or in a partially or fully neutralized state. The acidic free-radically polymerizable monomer may have more than one acidic groups and/or free-radically polymerizable groups.

Useful carbon-based acidic free-radically polymerizable monomers include, for example, (meth)acrylic acid, maleic acid, monoalkyl esters of maleic acid, fumaric acid, monoalkyl esters of fumaric acid, itaconic acid, isocrotonic acid, crotonic acid, citraconic acid, and beta-carboxyethyl acrylate.

Useful sulfur-based acidic free-radically polymerizable monomers include, for example, 2-sulfoethyl methacrylate, styrene sulfonic acid, and 2-acrylamido-2-methylpropanesulfonic acid.

Acidic, free radically polymerizable monomers are commercially available, for example, under the trade designations "PHOTOMER 4173" from Cognis Corp., Cincinnati, Ohio, and "CN118", "CD9050", "CD9051" and "CD9052" all from Sartomer Co., Exton Pa.

Useful phosphorus-based acidic free-radically polymerizable monomers include, for example, vinyl phosphonic acid.

The amount of acidic free-radically polymerizable monomer incorporated into the tie layer precursor is generally in a range of from at least 1, or 2 percent by weight up to and including 5, 10, 20, 30, or even 45 percent by weight, or more, based on the total weight of polyfunctional aziridine, acidic free-radically polymerizable monomer, and oligomer having at least two pendant free-radically polymerizable groups.

The oligomer having at least two pendant free-radically polymerizable groups is selected such that free-radical homopolymerization of the oligomer (e.g., by photo-or thermal initiation) results in a polymer having a glass transition temperature at or below 50 degrees Celsius (° C.). As used herein, the term "oligomer" refers to molecule composed of a small number of linked monomer units.

Oligomers generally have less than one hundred monomer units and more typically less than thirty.

Useful oligomers having at least two pendant free-radically polymerizable groups include, for example, aliphatic and aromatic urethane (meth)acrylate oligomers, polybutadiene (meth)acrylate oligomer, acrylic (meth)acrylate oligomers, polyether (meth)acrylate oligomers, aliphatic and aromatic polyester (meth)acrylate oligomers, epoxy (meth) acrylate oligomers, and combinations thereof.

Methods for making such oligomers are well known in the art, and many useful free-radically polymerizable oligomers are commercially available. Examples include aliphatic and aromatic urethane (meth)acrylate oligomers such as those available from UCB Chemicals Corp., Smyrna, Ga., under the trade designations "EBECRYL 270", "EBECRYL 8804", "EBECRYL 8807", "EBECRYL 4827", "EBECRYL 6700", "EBECRYL 5129", or "EBECRYL 8402" and those available from Sartomer Co., Exton, Pa., under the trade designations "CN 1963", "CN 934", "CN 953B70", "CN 984", "CN 962", "CN 964", "CN 965", "CN 972", "CN 978"; polyester (meth)acrylate oligomers such as those available from UCB Chemicals Corp. under the trade designations "EBECRYL 80", "EBECRYL 81", "EBECRYL 657", "EBECRYL 810", "EBECRYL 450", "EBECRYL 870", or "EBECRYL 2870" and that available from Sartomer Co. under the trade designation "CN 292"; polyether (meth)acrylate oligomers such as those available from Sartomer Co. under the trade designations "CN 501", "CN 502", "CN 550", "CN 551"; acrylic oligomers such as those available from Sartomer Co. under the trade designations "CN 816", "CN 817", "CN 818"; epoxy (meth)acrylate oligomers such as that available from Sartomer Co. under the trade designation, "CN119", and "CN121"; and polybutadiene (meth)acrylate oligomers such as that available from Sartomer Co. under the trade designation "CN 301".

The amount of oligomer incorporated into the tie layer precursor is generally in a range of from at least 30, 35, 40, or 45 percent by weight up to and including 50, 60, 70, 80, 90, or even 95 percent by weight, or more, based on the total weight of polyfunctional aziridine, acidic free-radically polymerizable monomer, and oligomer having at least two pendant free-radically polymerizable groups.

The tie layer precursor may, optionally, further comprise one or more curatives that are capable of at least partially polymerizing the tie layer precursor. Useful curatives include free-radical initiators such as, for example, photoinitiators and/or thermal initiators for free-radical polymerization. Blends of photo-and/or thermal initiators may be used.

Useful photoinitiators include those known as useful for photocuring free-radically polyfunctional acrylates. Exemplary photoinitiators include benzoin and its derivatives such as alpha-methylbenzoin; alpha-phenylbenzoin; alpha-allylbenzoin; alpha-benzylbenzoin; benzoin ethers such as benzil dimethyl ketal (e.g., as commercially available under the trade designation "IRGACURE 651" from Ciba Specialty Chemicals, Tarrytown, N.Y.), benzoin methyl ether, benzoin ethyl ether, benzoin n-butyl ether; acetophenone and its derivatives such as 2-hydroxy-2-methyl-1-phenyl-1-propanone (e.g., as commercially available under the trade designation "DAROCUR 1173" from Ciba Specialty Chemicals) and 1-hydroxycyclohexyl phenyl ketone (e.g., as commercially available under the trade designation "IRGACURE 184" from Ciba Specialty Chemicals); 2-methyl-1-[4-(methylthio)phenyl]-2-(4-morpholinyl)-1-propanone (e.g., as commercially available under the trade designation "IRGACURE 907" from Ciba Specialty Chemicals); 2-benzyl-2-(dimethylamino)-1-[4-(4-morpholinyl)phenyl]-1-butanone (e.g., as commercially available under the trade designation "IRGACURE 369" from Ciba Specialty Chemicals).

Other useful photoinitiators include, for example, pivaloin ethyl ether, anisoin ethyl ether, anthraquinones (e.g., anthraquinone, 2-ethylanthraquinone, 1-chloroanthraquinone, 1,4-dimethylanthraquinone, 1-methoxyanthraquinone, or benzanthraquinone), halomethyltriazines, benzophenone and its derivatives, iodonium salts and sulfonium salts, titanium complexes such as bis(eta$_5$-2,4-cyclopentadien-1-yl)-bis[2,6-difluoro-3-(1H-pyrrol-1-yl)phenyl]titanium (e.g., as commercially available under the trade designation "CGI 784DC" from Ciba Specialty Chemicals); halomethylnitrobenzenes (e.g., 4-bromomethylnitrobenzene), mono- and bis-acylphosphines (e.g., as commercially available from Ciba Specialty Chemicals under the trade designations "IRGACURE 1700", "IRGACURE 1800", "IRGACURE 1850", and "DAROCUR 4265").

One or more spectral sensitizers (e.g., dyes) may be added to the tie layer precursor in combination with the optional photoinitiator, for example, in order to increase sensitivity of the photoinitiator to a specific source of actinic radiation.

Examples of suitable thermal free-radical polymerization initiators include peroxides such as benzoyl peroxide, dibenzoyl peroxide, dilauryl peroxide, cyclohexane peroxide, methyl ethyl ketone peroxide; hydroperoxides such as tert-butyl hydroperoxide and cumene hydroperoxide; dicyclohexyl peroxydicarbonate; 2,2'-azobis(isobutyronitrile); and t-butyl perbenzoate. Examples of commercially available thermal free-radical polymerization initiators include initiators available from E. I. du Pont de Nemours and Co., Wilmington, Del., under the trade designation "VAZO" (e.g., "VAZO 64" and "VAZO 52") and from Elf Atochem North America, Philadelphia, Pa., under the trade designation "LUCIDOL 70".

If present, the curative is typically used in an amount effective to facilitate polymerization, for example, in an amount in a range of from about 0.01 percent by weight up to about 10 percent by weight, based on the total amount of tie layer precursor, although amounts outside of these ranges may also be useful.

In addition to other components, the tie layer precursor of the present invention may contain optional additives, for example, to modify performance and/or appearance. Exemplary additives include, fillers, solvents, plasticizers, wetting agents, surfactants, pigments, coupling agents, fragrances, fibers, lubricants, thixotropic materials, antistatic agents, suspending agents, pigments, and dyes.

Reactive diluents may also be added to the tie layer precursor, for example, to adjust viscosity and/or physical properties of the cured composition. Examples of suitable reactive diluents include diluents mono and polyfunctional (meth)acrylate monomers (e.g., ethylene glycol di(meth) acrylate, hexanediol di(meth)acrylate, triethylene glycol di(meth)acrylate, trimethylolpropane tri(meth)acrylate, tripropylene glycol di(meth)acrylate), vinyl ethers (e.g., butyl vinyl ether), vinyl esters (e.g., vinyl acetate), and styrenic monomers (e.g., styrene).

Typically, it is only necessary to combine the components under conditions wherein sufficient mixing occurs to prepare the tie layer precursor. In cases wherein the components of the composition are mutually soluble, the composition may be homogeneous throughout its entirety. To facilitate mixing agitation and/or stirring may be used. In instances, of higher viscosity, the mixture may be heated to reduce its viscosity.

The application of the tie layer precursor to the backing can be performed in a variety of ways including, for example, such techniques as brushing, spraying, roll coating, curtain coating, gravure coating, and knife coating. Organic solvent may be added to the isotropic polymerizable composition to facilitate the specific coating technique used. The coated backing may then be processed for a time at a temperature sufficient to dry (if organic solvent is present) and at least partially polymerize the coating thereby securing it to the backing. After an optional period of at least about 10, 20, or 30 seconds, or even longer, the tie layer precursor is typically at least partially polymerized, for example, by any of a number of well-known techniques such as, for example, by exposure electron beam radiation, actinic radiation (i.e., ultraviolet and/or visible electromagnetic radiation), and thermal energy. If actinic radiation is used, at least one photoinitiator is typically present in the tie layer precursor. If thermal energy is used, at least one thermal initiator is typically present in the tie layer precursor. The polymerization may be carried out in air or in an inert atmosphere such as, for example, nitrogen or argon.

In one exemplary embodiment, abrasive layer comprises a make layer comprising a first binder resin, abrasive particles embedded in the make layer, and a size layer comprising a second binder resin secured to the make layer and abrasive particles.

Referring to FIG. 1, exemplary coated abrasive article 100 according to the present invention has backing 110, tie layer 120 according to the present invention secured to major surface 115 of backing 110 and abrasive layer 130 secured to tie layer 120. Abrasive layer 130, in turn, includes abrasive particles 160 secured to tie layer 120 by make layer 140 and size layer 150.

The make and size layers may comprise any binder resin that is suitable for use in abrading applications. Typically, the make layer is prepared by coating at least a portion of the backing (treated or untreated) with a make layer precursor. Abrasive particles are then at least partially embedded (e.g., by electrostatic coating) in the make layer precursor comprising a first binder precursor, and the make layer precursor is at least partially polymerized. Next, the size layer is prepared by coating at least a portion of the make layer and abrasive particles with a size layer precursor comprising a second binder precursor (which may be the same as, or different from, the first binder precursor), and at least partially curing the size layer precursor. In one embodiment, the make layer precursor may be partially polymerized prior to coating with abrasive particles and further polymerized at a later point in the manufacturing process.

In one embodiment, a supersize may be applied to at least a portion of the size layer. Useful first and second binder precursors are well known in the abrasive art and include, for example, free-radically polymerizable monomer and/or oligomer, epoxy resins, phenolic resins, melamine-formaldehyde resins, aminoplast resins, cyanate resins, or combinations thereof.

Useful abrasive particles are well known in the abrasive art and include for example, fused aluminum oxide, heat treated aluminum oxide, white fused aluminum oxide, black silicon carbide, green silicon carbide, titanium diboride, boron carbide, tungsten carbide, titanium carbide, diamond, cubic boron nitride, garnet, fused alumina zirconia, sol gel abrasive particles, silica, iron oxide, chromia, ceria, zirconia, titania, silicates, metal carbonates (such as calcium carbonate (e.g., chalk, calcite, marl, travertine, marble and limestone), calcium magnesium carbonate, sodium carbonate, magnesium carbonate), silica (e.g., quartz, glass beads, glass bubbles and glass fibers) silicates (e.g., talc, clays, (montmorillonite) feldspar, mica, calcium silicate, calcium metasilicate, sodium aluminosilicate, sodium silicate) metal sulfates (e.g., calcium sulfate, barium sulfate, sodium sulfate, aluminum sodium sulfate, aluminum sulfate), gypsum, aluminum trihydrate, graphite, metal oxides (e.g., tin oxide, calcium oxide), aluminum oxide, titanium dioxide) and metal sulfites (e.g., calcium sulfite), metal particles (e.g., tin, lead, copper), plastic abrasive particles formed from a thermoplastic material (e.g., polycarbonate, polyetherimide, polyester, polyethylene, polysulfone, polystyrene, acrylonitrile-butadiene-styrene block copolymer, polypropylene, acetal polymers, polyvinyl chloride, polyurethanes, nylon), plastic abrasive particles formed from crosslinked polymers (e.g., phenolic resins, aminoplast resins, urethane resins, epoxy resins, melamine-formaldehyde, acrylate resins, acrylated isocyanurate resins, urea-formaldehyde resins, isocyanurate resins, acrylated urethane resins, acrylated epoxy resins), and combinations thereof.

Figure 2:
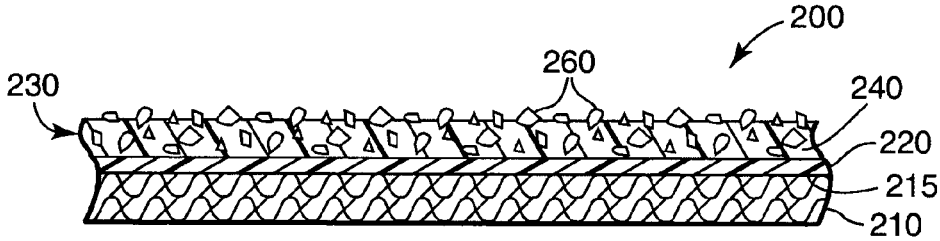
FIG. 2 is a cross-sectional view of another exemplary coated abrasive article.

In another exemplary embodiment of a coated abrasive article according to the present invention, the abrasive layer may comprise abrasive particles dispersed in a binder. Referring now to FIG. 2, exemplary coated abrasive article 200 has backing 210, tie layer 220 according to the present invention secured to major surface 215 of backing 210, and abrasive layer 230 secured to tie layer 220. Abrasive layer 230 includes abrasive particles 260 dispersed in binder 240.

In making such a coated abrasive article, a slurry comprising a binder precursor and abrasive particles is typically applied to a major surface of the backing, and the binder precursor is then at least partially cured. Suitable binder precursors and abrasive particles include, for example, those listed hereinabove.

Figure 3:
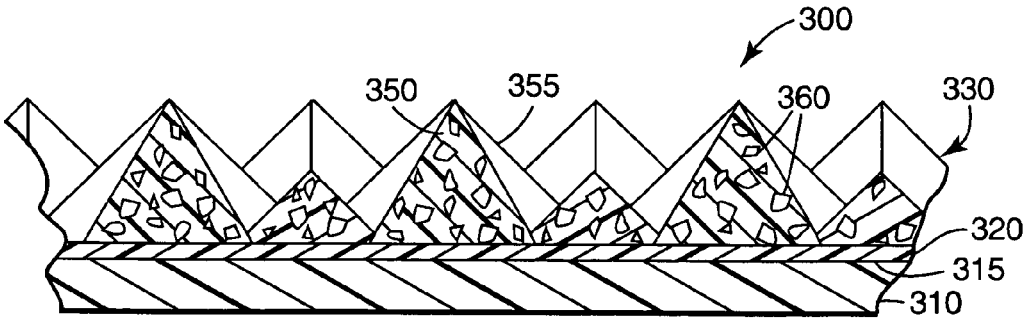
FIG. 3 is a cross-sectional view of another exemplary coated abrasive article.

In another exemplary embodiment, a coated abrasive article according to the present invention may comprise a structured abrasive article. Referring now to FIG. 3, exemplary structured abrasive article 300 has backing 310, tie layer 320 according to the present invention secured to major surface 315 of backing 310, and abrasive layer 330 secured to tie layer 320. Abrasive layer 330 includes a plurality of precisely-shaped abrasive composites 355. The abrasive composites comprise abrasive particles 360 dispersed in binder 350.

In making such a coated abrasive article, a slurry comprising a binder precursor and abrasive particles may be applied to a tool having a plurality of precisely-shaped cavities therein. The slurry is then at least partially polymerized and adhered to the tie layer, for example, by adhesive or addition polymerization of the slurry. Suitable binder precursors and abrasive particles include, for example, those listed hereinabove.

The abrasive composites may have a variety of shapes including, for example, those shapes selected from the group consisting of cubic, block-like, cylindrical, prismatic, pyramidal, truncated pyramidal, conical, truncated conical, cross-shaped, and hemispherical.

Optionally, coated abrasive articles may further comprise, for example, a backsize, a presize and/or subsize (i.e., a coating between the tie layer and the major surface to which the tie layer is secured), and/or a saturant which coats both major surfaces of the backing. Coated abrasive articles may further comprise a supersize covering at least a portion of the abrasive coat. If present, the supersize typically includes grinding aids and/or anti-loading materials.

Coated abrasive articles according to the present invention may be converted, for example, into belts, rolls, discs (including perforated discs), and/or sheets. For belt applications, two free ends of the abrasive sheet may be joined together using known methods to form a spliced belt.

Further description of techniques and materials for making coated abrasive articles may be found in, for example, U.S. Pat. No. 4,314,827 (Leitheiser et al.); U.S. Pat. No. 4,518,397 (Leitheiser et al.); U.S. Pat. No. 4,588,419 (Caul et al.); U.S. Pat. No. 4,623,364 (Cottringer et al.); U.S. Pat. No. 4,652,275 (Bloecher et al.); U.S. Pat. No. 4,734,104 (Broberg); U.S. Pat. No. 4,737,163 (Larkey); U.S. Pat. No. 4,744,802 (Schwabel); U.S. Pat. No. 4,751,138 (Tumey et al.); U.S. Pat. No. 4,770,671 (Monroe et al.); U.S. Pat. No. 4,799,939 (Bloecher et al.); U.S. Pat. No. 4,881,951 (Wood et al.); U.S. Pat. No. 4,927,431 (Buchanan et al.); U.S. Pat. No. 5,498,269 (Larmie); U.S. Pat. No. 5,011,508 (Wald et al.); U.S. Pat. No. 5,078,753 (Broberg et al.); U.S. Pat. No. 5,090,968 (Pellow); U.S. Pat. No. 5,108,463 (Buchanan et al.); U.S. Pat. No. 5,137,542 (Buchanan et al.); U.S. Pat. No. 5,139,978 (Wood); U.S. Pat. No. 5,152,917 (Pieper et al.); U.S. Pat. No. 5,201,916 (Berg et al.); U.S. Pat. No. 5,203,884 (Buchanan et al.); U.S. Pat. No. 5,227,104 (Bauer); U.S. Pat. No. 5,304,223 (Pieper et al.); U.S. Pat. No. 5,328,716 (Buchanan); U.S. Pat. No. 5,366,523 (Rowenhorst et al.); U.S. Pat. No. 5,378,251 (Culler et al.); U.S. Pat. No. 5,417,726 (Stout et al.); U.S. Pat. No. 5,429,647 (Larmie); U.S. Pat. No. 5,436,063 (Follett et al.); U.S. Pat. No. 5,490,878 (Peterson et al.); U.S. Pat. No. 5,492,550 (Krishnan et al.); U.S. Pat. No. 5,496,386 (Broberg et al.); U.S. Pat. No. 5,520,711 (Helmin); U.S. Pat. No. 5,549,962 (Holmes et al.); U.S. Pat. No. 5,551,963 (Larmie); U.S. Pat. No. 5,556,437 (Lee et al.); U.S. Pat. No. 5,560,753 (Buchanan et al.); U.S. Pat. No. 5,573,619 (Benedict et al.); U.S. Pat. No. 5,609,706 (Benedict et al.); U.S. Pat. No. 5,672,186 (Chesley et al.); U.S. Pat. No. 5,700,302 (Stoetzel et al.); U.S. Pat. No. 5,851,247 (Stoetzel et al.); U.S. Pat. No. 5,913,716 (Mucci et al.); U.S. Pat. No. 5,942,015 (Culler et al.); U.S. Pat. No. 5,954,844 (Law et al.); U.S. Pat. No. 5,961,674 (Gagliardi et al.); U.S. Pat. No. 5,975,988 (Christianson); U.S. Pat. No. 6,059,850 (Lise et al.); and U.S. Pat. No. 6,261,682 (Law), the disclosures of which are incorporated herein by reference.

Abrasive articles according to the present invention are useful for abrading a workpiece in a process wherein at least a portion of the abrasive layer of a coated abrasive article is frictionally contacted with the abrasive layer with at least a portion of a surface of the workpiece, and then at least one of the coated abrasive article or the workpiece is moved relative to the other to abrade at least a portion of the surface. The abrading process may be carried out, for example, by hand or by machine. Optionally, liquid (e.g., water, oil) and/or surfactant (e.g., soap, nonionic surfactant) may be applied to the workpiece, for example, to facilitate the abrading process.

Objects and advantages of this invention are further illustrated by the following non-limiting examples, but the particular materials and amounts thereof recited in these examples, as well as other conditions and, details, should not be construed to unduly limit this invention.

EXAMPLES

Unless otherwise noted, all parts, percentages, ratios, etc. in the examples and the rest of the specification are by weight, and all reagents used in the examples were obtained, or are available, from general chemical suppliers such as, for example, Sigma-Aldrich Co., Saint Louis, Mo., or may be synthesized by conventional methods.

The following abbreviations are used throughout the Examples.

TABLE OF ABBREVIATIONS

| | |
|---|---|
| A1 | silane methacrylate commercially available from GE Silicones, Friendly, West Virginia under the trade designation "SILANE A-174NT" |
| A2 | silicon dioxide commercially available from Degussa Corp., Parsippany, New Jersey under the trade designation "SILICONE DIOXIDE OX-50 AEROSIL" |
| ACR1 | trimethylolpropane triacrylate, commercially available under the trade designation "TMPTA-N" from UCB Group, Springfield, Massachusetts |
| AFR1 | acid modified epoxy acrylate, commercially available under the trade designation "CN118" from Sartomer Co., Exton, Pennsylvania |
| AFR2 | monofunctional acid ester acrylate, commercially available under the trade designation "CD9050" from Sartomer Co. |
| AFR3 | trifunctional acid ester acrylate, commercially available under the trade designation "CD9052" from Sartomer Co. |
| AFR4 | acidic aromatic acrylate oligomer, commercially available under the trade designation "PHOTOMER 4173" from Cognis Corp., Cincinnati, Ohio |
| AZ1 | polyfunctional aziridine commercially available under the trade designation from "HYDROFLEX XR-2990" from H. B. Fuller Co. |
| BK1 | a treated fabric backing, prepared according to the following procedure: follows: EPR1 (11,306, grams (g)) was mixed with 1507 g of ACR1 and 151 g of PI2 at 20° C. until homogeneous using a mechanical stirrer. The mixture was then heated at 50° C. in an oven for 2 hours. After removing the mixture from the oven, 1206 grams DICY was added and with stirring for 10 minutes. Next, 754 g of NOV1 was added and stirring continued for 10 minutes. 114 g of CUR2 was added and stirring continued until dissolved. A 30.5 cm wide coating knife obtained from the Paul N. Gardner Co., Pompano Beach, Florida, and a 30 cm × 30 cm × 2.5 cm machined stainless steel coating platform were heated to 66° C. The knife was set to a minimum gap of 225 micrometers. A 100% polyester 4/1 sateen fabric made from open-end spun yarns weighing 326 grams/meter$^2$, commercially available under the trade designation "POWERSTRAIGHT" from Milliken and Co., Spartanburg, South Carolina, was placed under the coating knife. The resin composition was poured onto the polyester fabric and then the fabric was pulled by hand under the knife to form a presize coat on the fabric. The pre-sized fabric was then irradiated by passing once through a UV processor obtained under the trade designation "UV |

-continued

| TABLE OF ABBREVIATIONS | |
|---|---|
| | PROCESSOR", obtained from Fusion UV Systems, Gaithersburg, Maryland, using a "FUSION D" bulb at 761 Watts/inch$^2$ (118 W/cm$^2$) and 16.4 feet/minute (5 m/min), then thermally cured at 160° C. for 5 minutes. The resultant pre-size coating weight was 106 g of/meter$^2$. A resin blend was prepared, by mixing until homogeneous at 20° C., 55 percent by weight FL1; 43 percent by weight RPR1 and a small amount of red $Fe_2O_3$ (2 percent by weight) for color. The backside of the fabric was then coated with this resin blend and cured at 90° C. for 10 minutes, then at 105° C. for 15 minutes. The resultant backsize coating weight was 111.5 grams/meter$^2$. |
| BK2 | a treated fabric backing, prepared according to the following procedure: A resin blend was prepared by mixing until homogeneous at 20° C., 90 percent by weight of RPR1 and 10 percent by weight of NLR1. This resin blend was applied as a saturant to the a 100 percent polyester 4/1 sateen fabric made from open end spun yarns weighing 326 grams/meter$^2$, commercially available under the trade designation "POWERSTRAIGHT" from Milliken and Co., Spartanburg, South Carolina. The resin-coated fabric was then heated at 90° C. for 10 minutes, and then at 105° C. for 15 minutes. The resultant saturant coating was 75 grams/meter$^2$. A backsize treatment was applied as described in Backing Treatment 1, to give a backsize coat of 50 grams/meter$^2$. |
| BK3 | unprimed 2 mil polyester film commercially available from DuPont Teijin Films, Hopewell, Virginia under the trade designation "MYLAR" |
| BR1 | acrylated aliphatic urethane, commercially available under the trade designation "EBECRYL 8402" from UCB Group |
| BR2 | acrylated polyester, obtained under the trade designation "EBECRYL 810" from UCB Group |
| CUR1 | polyamide epoxy curing agent, commercially available under the trade designation "VERSAMID 125" from Cognis Corp. |
| CUR2 | 2-propylimidazole, commercially available under the trade designation "ACTIRON NXJ-60 LIQUID" from Synthron, Morganton, North Carolina |
| CUR3 | modified aliphatic amine, obtained under the trade designation "ANCAMINE AD CURING AGENT" from Air Products and Chemicals, Allentown, Pennsylvania |
| DICY | dicyandiamide (having an average particle size of less than 10 micrometers), commercially available under the trade designation "AMICURE CG-1400" from Air Products and Chemicals |
| EPR1 | epoxy resin commercially available under the trade designation "EPON 828" from Resolution Performance Products, Houston, Texas |
| FL1 | calcium carbonate filler commercially available from J.W. Huber Corp., Atlanta, Georgia, under the trade designation "HUBERCARB Q325" |
| FL2 | calcium metasilicate commercially available from NYCO Minerals, Wilisboro, New York, under the trade designation "400 WOLLASTACOAT" |
| LA1 | hot melt adhesive, commercially available under the trade designation "JET-MELT HOT MELT ADHESIVE PG3779" from 3M Company |
| LA2 | adhesive composition, prepared according to the following procedure: A 237-milliliter jar was charged with 132 grams ER1, 56 grams CUR1, 120 grams FL1 and 10 grams CUR3. The mixture was stirred until homogeneous using a low shear mixer. |
| MN1 | ANSI grade 36 aluminum oxide commercially available from Washington Mills Electro Minerals, Niagara Falls, New York |
| MN2 | sol-gel abrasive grain, commercially available under the trade designation "GRADE JIS 400 3M CUBITRON 321" from 3M Company |
| NLR1 | nitrile latex resin, commercially available under the trade designation "HYCAR 1581" from Noveon, Cleveland, Ohio |
| NOV1 | novolac resin, commercially available under the trade designation "RUTAPHEN 8656F" from Bakelite AG, Frielendorf, German |
| pbw | parts by weight |
| PI1 | 2-benzyl-2-(dimethylamino)-1-[4-(4-morpholinyl)phenyl]-1-butanone, commercially available under the trade designation "IRGACURE 369" from Ciba Specialty Chemicals, Hawthorne, New York |
| PI2 | 2,2-dimethoxy-2-phenylacetophenone, commercially available under the trade designation "IRGACURE 651" from Ciba Specialty Chemicals |
| RPR1 | resole phenolic (a phenol-formaldehyde resin, having phenol to formaldehyde ratio of 1.5–2.1/1, catalyzed with 2.5 percent potassium hydroxide |

90° Peel Adhesion Test

The coated abrasive article to be tested is converted into an about 8 cm wide by 25 cm long piece. One-half the length of a wooden board (17.8 cm by 7.6 cm by 0.6 cm) is coated with either Laminating Adhesive 1 (LA1) or Laminating Adhesive 2 (LA2), described below. With respect to LA1, the adhesive is applied with a hot melt glue gun (commercially available under the trade designation "POLYGUN II HOT MELT APPLICATOR" from 3M Company). With respect to LA2, the adhesive is manually applied by brushing with a 2-inch (5.1-cm) paintbrush. The entire width of, but only the first 15 cm of the length of, the coated abrasive article is coated with laminating adhesive on the side bearing the abrasive particles. The side of the coated abrasive article bearing the abrasive particles is attached to the side of the board containing the laminating adhesive coating in such a manner that the 10 cm of the coated abrasive article not bearing the laminating adhesive overhung from the board.

Pressure is applied such that the board and the coated abrasive article were intimately bonded. With respect to LA2, the bonded board and coated abrasive article assembly is cured at 25° C. for about 12 hours and at 50° C. for 12 hours.

Operating at 25° C., the abrasive article to be tested is cut along a straight line on both sides of the article such that the width of the coated abrasive article is reduced to 5.1 cm. The resulting abrasive article/board composite is mounted horizontally in a fixture attached to the upper jaw of a tensile testing machine, commercially available under the trade designation "SINTECH 6 W" from MTS Systems Corp., Eden Prairie, Minn. Approximately 1 cm of the overhanging portion of the coated abrasive article is mounted into the lower jaw of the machine such that the distance between the jaws is 12.7 cm. The machine separates the jaws at a rate of 0.05 centimeter/second (cm/sec), with the coated abrasive article being pulled at an angle of 90° away from the wooden board so that a portion of the coated abrasive article separated from the board. The force required for such separation (i.e., stripback force) is reported in kilograms/centimeter (kg/cm).

General Method for Preparation of Tie Layer Precursor Composition

Acidic, free-radically polymerizable monomer is added to the oligomer having at least two pendant free-radically polymerizable groups, followed by the initiator, at 20° C. The mixture is stirred until homogeneous using a mechanical stirrer, then heated at 50° C. in an oven for 2 hours. After removing the mixture from the oven, the polyfunctional aziridine is added, and the stirring continued for 10 minutes until the polyfunctional aziridine dissolved, resulting in an isotropic tie layer precursor composition.

General Method for Preparation of Backing with Tie Layer

Freshly prepared, warm tie layer precursor composition is applied to a treated backing, as indicated, using a 4-inch (1.6-cm) wide hand-held coating knife, available from the Paul N. Gardner Company, Pompano Beach, Fla. The knife gap is set at 225 micrometers. The resultant tie layer precursor-coated backing is then irradiated by passing once through a UV processor obtained under the trade designation "UV PROCESSOR", obtained from Fusion UV Systems, Gaithersburg, Md., using a "FUSION D" bulb at 761 Watts/inch$^2$ (118 W/cm$^2$) and 16.4 feet/minute (5 m/min), then heated at 120° C. for 10 to 20 minutes to give a backing having a tie layer secured thereto. The nominal coating weight of the resultant tie layer is 110 grams/m$^2$.

Preparation of Slurry Resin 1 (SR1)

A one-gallon (4-L) plastic container was charged with 1917 g of ACR1, 19 g of PI1, 1738 g of F2, 2235 of MN2, 74 g of A1 and 17 g of A2. The resin was mechanically stirred at 25° C. for 1 hour.

Preparation of Powder Coat 1 (PC1)

A powder coat of resin and mineral was prepared as described in Example 1 of U.S. Pat. Appl. 20040018802 (Welygan et al.).

Preparation of Binder Precursor 1 (BP1)

A one-gallon (4-L) plastic container was charged with 544 g of RPR1 and 442 g of F1. The reaction was stirred with an overhead stirrer for 30 minutes, and then diluted with water to reach a total weight of one kilogram.

Preparation of Binder Precursor 2 (BP2)

A one-gallon (4-L) plastic container was charged with 425 g of ACR1, 11 g of PI2 and 726 g of F1 and mechanica General Method for Bonding an Abrasive Layer to a Tie Layer Abrasive layers are bonded to the tie layer according to the following procedures:

Binder Precursor 1 or 2 is coated onto the tie layer using a handheld coating knife at a coating thickness of 4 mils (101 micrometers).

For examples coated with Binder Precursor 1, Binder Precursor 1 is coated onto the tie layer using a handheld coating knife at a coating thickness of 4 mils (101 micrometers). MN1 is drop-coated into Binder Precursor 1 to form a closed mineral coat, then Binder Precursor 1 is heated at 90° C. for 60 minutes, and then at 105° C. for 12 hours.

For examples coated with Binder Precursor 2, Binder Precursor 2 is coated onto the tie layer using a handheld coating knife at a coating thickness of 4 mils (101 micrometers). MN1 is drop-coated into the Binder Precursor 2 to form a closed mineral coat, and Binder Precursor 2 is passed once through a UV processor obtained under the trade designation "UV PROCESSOR", obtained from Fusion UV Systems, Gaithersburg, Md., using a "FUSION D" bulb at 761 Watts/inch$^2$ (118 W/cm$^2$) and 16.4 feet/minute (5 m/min).

For examples coated with Powder Coat 1, Powder Coat 1 is coated onto the tie layer using a handheld coating knife at a coating thickness of 10 mils. The resultant powder coating is melted by passing under IR lamps at 25 fpm (7.6 m/min), and is then heated at 150° C. for 1 hour.

For examples coated with Slurry 1, Slurry 1 is coated onto the tie layer using a handheld coating knife at a coating thickness of 2–3 mils (101 micrometers) onto a tool having precisely-shaped cavities therein as described in Example 1 of U.S. patent application Ser. No. 10/668,736 (Collins et al.), the disclosure of which is incorporated herein by reference, and then transferred to tie layer. The slurry is passed once through two UV processors obtained under the trade designation "UV PROCESSOR", obtained from Fusion UV Systems, Gaithersburg, Md., using a "FUSION D" bulb at 761 Watts/inch$^2$ (118 W/cm$^2$) and 50 feet/minute (15 m/min), and then heated at 120° C. for 24 hours.

EXAMPLES 1–25

As indicated in Table 1, tie layer precursors were prepared according to the General Method for Preparation of Tie Layer Precursor. The tie layer precursors were then coated on the indicated backing and cured to form a tie layer according to the General Method for Preparation of Backing with Tie Layer. An Abrasive Layer was then applied to the tie-coat layer. The resultant coated abrasive articles were subjected to the 90° Peel Adhesion Test. In Table 1, the coated abrasives failed within the coated abrasive.

TABLE 1

| | Tie Layer Precursor Components | | | | | | | |
|---|---|---|---|---|---|---|---|---|
| Example | Oligomer/ amount, pbw | Acidic monomer/ amount, pbw | Curative/ amount, pbw | AZ1, pbw | Backing | Abrasive Binder Precursor | Laminating Adhesive | Stripback Force (kg/cm) |
| 1 | BR1/90 | AFR3/10 | PI1/1 | 1 | BK1 | SL1 | LA1 | 2.99 |
| 2 | BR1/90 | AFR3/10 | PI1/1 | 2 | BK1 | SL1 | LA1 | 3.47 |
| 3 | BR1/90 | AFR3/10 | PI1/1 | 5 | BK1 | SL1 | LA1 | 2.65 |
| 4 | BR2/89 | AFR4/5 | PI2/1 | 5 | BK1 | SL1 | LA1 | 4.03 |
| 5 | BR2/74 | AFR1/20 | PI2/1 | 5 | BK1 | SL1 | LA1 | 1.92 |
| 6 | BR2/79 | AFR3/10, AFR4/5 | PI2/1 | 5 | BK1 | SL1 | LA1 | 3.67 |
| 7 | BR1/86 | AFR4/8 | PI2/1 | 5 | BK1 | SL1 | LA2 | 6.19 |
| 8 | BR1/91 | AFR4/5 | PI2/1 | 3 | BK1 | SL1 | LA2 | 6.00 |
| 9 | BR2/86 | AFR4/8 | PI2/1 | 5 | BK1 | SL1 | LA2 | 5.91 |
| 10 | BR2/92 | AFR4/2 | PI2/1 | 5 | BK1 | SL1 | LA2 | 4.76 |
| 11 | BR1/83.5 | AFR3/12.5 | PI2/1 | 3 | BK1 | SL1 | LA2 | 6.03 |
| 12 | BR1/89 | AFR3/5 | PI2/1 | 5 | BK1 | SL1 | LA2 | 5.87 |
| 13 | BR2/83.5 | AFR3/12.5 | PI2/1 | 3 | BK1 | SL1 | LA2 | 4.78 |
| 14 | BR2/89 | AFR3/5 | PI2/1 | 5 | BK1 | SL1 | LA2 | 5.08 |
| 15 | BR1/78 | AFR2/20 | PI2/1 | 1 | BK1 | SL1 | LA2 | 4.69 |
| 16 | BR1/74 | AFR2/20 | PI2/1 | 5 | BK1 | SL1 | LA2 | 4.40 |
| 17 | BR2/89 | AFR2/5 | PI2/1 | 5 | BK1 | SL1 | LA2 | 5.03 |
| 18 | BR2/86 | AFR4/8 | PI2/1 | 5 | BK2 | SL1 | LA2 | 3.88 |
| 19 | BR1/92 | AFR4/2 | PI2/1 | 5 | BK2 | SL1 | LA2 | 3.70 |
| 20 | BR1/90 | AFR4/8 | PI2/1 | 1 | BK2 | SL1 | LA2 | 3.11 |
| 21 | BR2/92 | AFR4/2 | PI2/1 | 5 | BK2 | SL1 | LA2 | 3.38 |
| 22 | BR1/91 | AFR4/5 | PI2/1 | 3 | BK1 | BP1 | LA1 | 1.36 |
| 23 | BR1/91 | AFR4/5 | PI2/1 | 3 | BK1 | BP2 | LA1 | 1.32 |
| 24 | BR1/91 | AFR4/5 | PI2/1 | 3 | BK1 | PC1 | LA1 | 2.19 |
| 25 | BR1/91 | AFR4/5 | PI2/1 | 3 | BK3 | SL1 | LA1 | Film Separated* |

*Adhesion of abrasive and tie layer to film exceeded internal strength of film, which resulted in film separation Various modifications and alterations of this invention may be made by those skilled in the art without departing from the scope and spirit of this invention, and it should be understood that this invention is not to be unduly limited to the illustrative embodiments set forth herein.

What is claimed is:

1. A coated abrasive article comprising a backing having a major surface, a tie layer secured to at least a portion of the major surface, an abrasive layer secured to at least a portion of the tie layer, the abrasive layer comprising abrasive particles and at least one binder resin, wherein the tie layer is preparable by at least partially free-radically polymerizing an isotropic polymerizable composition comprising, based on the total weight polyfunctional aziridine, acidic free-radically polymerizable monomer, and oligomer having at least two pendant free-radically polymerizable groups; at least 0.5 percent of at least one polyfunctional aziridine, at least 1 percent of at least one acidic free-radically polymerizable monomer, and at least 30 percent of at least one oligomer having at least two pendant free-radically polymerizable groups, wherein homopolymerzation of the oligomer results in a polymer having a glass transition temperature of less than 50 degrees Celsius.

2. A coated abrasive article according to claim 1, wherein the isotropic polyrnerizable composition, further comprises a curative.

3. A coated abrasive article according to claim 2, wherein the curative comprises at least one freeradical photoinitiator.

4. A coated abrasive article according to claim 2, wherein the curative comprises at least one free-radical thermal initiator.

5. A coated abrasive article according to claim 2, wherein based on the total weight of acidic free-radically polymerizable monomer, and oligomer having at least two free-radically polymerizable groups, the amount of polyfunctional aziridine is in a range of from 0.5 to 10 percent,and wherein the amount of acidic free-radically polymerizable monomer is in a range of from 1 to 45 percent.

6. A coated abrasive article according to claim 2, wherein based on the total weight of acidic free-radically polymerizable monomer, and oligomer having at least two free-radically polymerizable groups, the amount of polyfunctional aziridine is in a range of from 2 to 4 percent, and wherein the amount of acidic free-radically polymerizabie monomer is in a range of from 2 to 20 percent.

7. A coated abrasive article according to claim 2, wherein the polyfunctional aziridine is selected from the group consisting of trimethylolpropane tris[3-aziridinayl propinate]; trimethylolpropane tris[3-(2-methylaziridinyl)propinate]; trimethylolpropane tris[2-aziridinylbutyrate]; tris(1-aziridinyl)phosphine oxide; tris(2-methyl-1-aziridinylphosphine oxide; pentaerythritol tris[3-(1-aziridinyl) propinate]; and pentaerythritol tetrakis[3-(1-aziridinyl) propionate], and combinations thereof.

8. A coated abrasive article according to claim 7, wherein the abrasive layer comprises a make layer comprising a first binder resin, wherein the abrasive particles are embedded in the make layer, and a size layer comprising a second binder resin secured to the make layer and the abrasive particles.

9. A coated abrasive article according to claim 2, wherein the acidic free-radically polymerizable monomer is selected from the group consisting of (meth)acrylic acid, maleic acid, monoalkyl esters or maleic acid, fumaric acid, monoalkyl esters of fumaric acid, itaconic acid, isocrotonic acid, crotonic acid, and beta-carboxyethyl acrylate, 2-sulfoethyl methacrylate, styrene sulfonic acid, and 2-acrylamido-2-methylpropanesulfonic acid, vinyl phosphonic acid, and combinations thereof.

10. A coated abrasive article according to claim 2, wherein the oligomer having at least two pendant free-radically polymerizabie groups is selected from the group consisting of aliphatic and aromatic urethane (meth)acrylate oligomers, polybutadiene (meth)acrylate oligomer, acrylic (meth)acrylate oligomers, polyether (meth)acrylate oligomers, aliphatic and aromatic polyester (meth)acrylate oligomers, epoxy (meth)acrylate oligomers, and combinations thereof.

11. A coated abrasive article according to claim 1, wherein the abrasive layer is preparable from components comprising at least one free-radically polymerizable monomer, free-radically polymerizable oligomer, epoxy resin, phenolic resin, melamine-formaldehyde resin, aminoplast resin, cyanate resin, or a combination thereof.

12. A coated abrasive article according to claim 1, wherein the abrasive layer comprises a make layer comprising, a first binder resin, wherein the abrasive particles are embedded in the make layer, and a size layer comprising a second binder resin secured to the make layer and the abrasive particles.

13. A coated abrasive article according to claim 12, wherein the abrasive layer further comprises a supersize.

14. A coated abrasive article according to claim 12, wherein the backing comprises a treated backing comprising at least one treatment selected from the group consisting of a presize, a backsize, a subsize, and a saturant.

15. A coated abrasive article according to claim 1, wherein the abrasive particles are dispersed in the binder resin.

16. A coated abrasive article according to claim 15, wherein the isotropic polymerizable composition further comprises a curative.

17. A coated abrasive article according to claim 16, wherein the curative comprises at least one free-radical photoinitiator.

18. A coated abrasive article according to claim 16, wherein the curative comprises at least one free-radical thermal initiator.

19. A coated abrasive article according to claim 15, wherein based on the total weight of acidic free-radically polymerizabie monomer, and oligomer having at least two free-radically polymerizable groups, the amount of polyfunctional aziridine is in a range of from 0.5 to 10 percent, wherein the amount of acidic free-radically polymerizable monomer is in a range of from 01 to 45 percent.

20. A coated abrasive article according to claim 15, wherein based on the total weight of acidic free-radically polymerizable monomer, and oligomer having at least two free-radically polymerizable groups, the amount of polyfunctional aziridine is in a range of from 2 to 4 percent, and wherein the amount of acidic free-radically polymerizable monomer is in a range of from 2 to 20 percent.

21. A coated abrasive article according to claim 15, wherein the polyfunctional aziridine is selected from the group consisting of trimethylolpropane tris[3-aziridinyl propinate]; trimethylolpropane tris[3-(2-methylaziridinyl) propionate]; trimethylolpropane tris [2-aziridinylbutyrate]; tris(1-aziridinyl)phosphine oxide; tris(2-methyl-1-aziridinyl)phosphine oxide; pentaerythritol tris[3-(1-aziridinyl) propionate]; and pentaerythritol tetrakis[3-(1-aziridinyl) propionate], and combinations thereof.

22. A coated abrasive article according to claim 15, wherein the acidic free-radically polymerizable monomer is selected from the group consisting of (meth)acrylic acid, maleic acid, monoalkyl esters of maleic acid, fumaric acid, monoalkyl esters of fumaric acid, itaconic acid, isocrotonic acid, crotonic acid, citraconic acid, and beta-carboxyethyl acrylate, 2-sulfoethyl methacrylate, styrene sulfonic acid, and 2-acrylamido-2-methypropanesulfonic acid, vinyl phosphonic acid, and combinations thereof.

23. A coated abrasive article according to claim 15, wherein the oligomer having at least two pendant free-radically polymerizable groups is selected from the group consisting of aliphatic and aromatic urethane (meth)acrylate oligomers, polybutadiene (meth)acrylate oligomer, acrylic (meth)acrylate oligomers, polyether (meth)acrylate oligomers, aliphatic and aromatic polyester (meth)acrylate oligomers, epoxy (meth)acrylate oligomers, and combinations thereof.

24. A coated abrasive article according to claim 15, wherein the backing is a treated backing comprising at least one of a presize, a backsize, or a subsize.

25. A coated abrasive article according to claim 15, wherein the abrasive layer comprises precisely-shaped abrasive composites.

26. A coated abrasive article according to claim 25, wherein the backing comprises polymeric film.

27. A coated abrasive article according to claim 25, wherein the composition further comprises a curative.

28. A method of making a coated abrasive article comprising:

disposing a tie layer precursor on at least a portion of a backing, the tie layer precursor comprising an isotropic composition comprising, based on the total weight of polyfunctional aziridine, acidic free-radically polymerizable monomer, and oligomer having at least two pendant free-radically polymerizable groups; at least 0.5 percent of at least one polyfunctional aziridine, at least 1 percent of at least one acidic free-radically polymerizable monomer, and at least 30 percent of at least one oligomer having at least two pendant free-radically polymerizable groups, wherein homopolymerization of the oligomer results in a polymer having glass transition temperature of less than 50 degrees Celsius; and at least partially free-radically polymerizing the tie layer precursor;

disposing a polymerizable make resin precursor on the at least partially polymerized tie layer precursor;

at least partially embedding abrasive particles in the make resin precursor; and at least partially polymerizing the make resin precursor.

29. A method according to claim 28, further comprising:

disposing a polymerizable size resin precursor on at least a portion of the at least partially polymerized make resin and abrasive particles; and at least partially polymerizing the size resin precursor.

30. A method according to claim 28, wherein the backing is a treated backing having at least one treatment secured thereto selected from the group consisting of a presize, a backsize, a sub-size, and a saturant.

31. A method of making a coated abrasive article comprising:

disposing a tie layer precursor on at least a portion of a backing, the tie layer precursor comprising an isotropic composition comprising, based on the total weight of polyfunctional aziridine, acidic free-radically polymerizable monomer, and oligomer having at least two pendant free-radically polymerizable groups; at least 0.5 percent of at least one polyfunctional aziridine, at least 1 percent of at least one acidic free-radically polymerizable monomer, and at least 30 percent of at least one oligomer having at least two pendant free-radically polymerizable groups, wherein homopolymerization of the oligomer results in a polymer having a glass transition temperature of less than 50 degrees Celsius; and at least partially fee-radically polymerizing the tie layer precursor;

disposing a slurry comprising polymerizable binder precursor and abrasive particles on the at least partially polymerized tie layer precursor; and at least partially polymerizing the binder precursor.

32. A method according to claim 31, wherein the backing is a treated backing, having at least one treatment secured thereto selected from the group consisting of a presize, a backsize, a subsize, and a saturant.

33. A method according to claim 31, further comprising providing a tool having a surface with plurality of precisely-shaped cavities therein, and urging the slurry into at least a portion of the cavities prior to disposing the slurry on the at least partially polymerized tie layer precursor.

34. A method of abrading a workpiece comprising:

providing a coated abrasive article according to claim 1;

frictionally contacting at least a portion of the abrasive layer with at least a portion of a surface of the workpiece; and moving at least one of the coated abrasive article or the workpiece relative to the other to abrade at least a portion of the surface.

35. A method of abrading a workpiece comprising:

providing a coated abrasive article according to claim 11;

frictionally contacting at least a portion of the size layer with at least a portion of a surface of the workpiece; and moving at least one of the coated abrasive article or the workpiece relative to the other to abrade at least a portion of the surface.

36. A method of abrading a workpiece comprising:

providing a coated abrasive article according to claim 15;

frictionally contacting at least a portion of the abrasive layer with at least a portion of a surface of the workpiece; and moving at least one of the coated abrasive article or the workpiece relative to the other to abrade at least a portion of the surface.

37. A method of abrading a workpiece comprising:

providing a coated abrasive article according to claim 25;

frictionally contacting at least a portion of the abrasive layer with at least a portion of a surface of the workpiece; and moving at least one of the coated abrasive article or the workpiece relative to the other to abrade at least a portion of the surface.

* * * * *

UNITED STATES PATENT AND TRADEMARK OFFICE

CERTIFICATE OF CORRECTION

PATENT NO. : 7,150,770 B2
APPLICATION NO. : 10/871455
DATED : December 19, 2006
INVENTOR(S) : Steven J. Keipert It is certified that error appears in the above-identified patent and that said Letters Patent is hereby corrected as shown below:

On the title page item (56),

Page 2, Column 2
Line 19 (U.S. Patent Documents), delete "B1" following "6,475,253" and insert -- B2 -- in place thereof.
Line 20, (U.S. Patent Documents), delete "B1" following "6,645,624" and insert -- B2 -- in place thereof.

Column 11
Line 41, delete "Wilisboro," and insert -- Willsboro -- in place thereof.

Column 14
Line 6. delete "mechanica" and insert -- mechanically stirred at 25°C for one hour. -- in place thereof.

Column 15
Line 48, Claim 1, insert -- of -- following "weight".
Line 55. Claim 1, delete "homopolymerzation" and insert -- homopolymerization -- in place thereof.
Line 59, Claim 2, delete "polynerizable" and insert -- polymerizable -- in place thereof.
Line 59, Claim 2, delete "composition," and insert -- composition -- in place thereof.
Line 62, Claim 3, delete "freeradical" and insert -- free-radical -- in place thereof.

Column 16
Line 37, Claim 5, delete "percent,and" and insert -- percent, and -- in place thereof.
Line 45, Claim 6, delete "polymerizabie" and insert -- polymerizable -- in place thereof.
Line 49-50, Claim 7, delete "[3-aziridinayl propinate];" and insert -- [3-aziridinyl propionate]; -- in place thereof.
Line 50-51, Claim 7, delete "propionate];" and insert -- propinate]; -- in place thereof.
Line 53, Claim 7, delete "aziridinylphosphine" and insert -- aziridinyl)phosphine -- in place thereof.
Line 54, Claim 7, delete "propionate];" and insert -- propionate]; -- in place thereof.
Line 65, Claim 9, delete "or" following "esters" and insert -- of -- in place thereof.
Line 67, Claim 9, insert -- citraconic acid, -- following "acid,".

Column 17
Line 6, Claim 10, delete "polymerizabie" and insert -- polymerizable -- in place thereof.
Line 45, Claim 19, delete "polymerizabie" and insert -- polymerizable -- in place thereof.
Line 47, Claim 19, insert -- and -- following "10 percent".

UNITED STATES PATENT AND TRADEMARK OFFICE

CERTIFICATE OF CORRECTION

PATENT NO. : 7,150,770 B2
APPLICATION NO. : 10/871455
DATED : December 19, 2006
INVENTOR(S) : Steven J. Keipert It is certified that error appears in the above-identified patent and that said Letters Patent is hereby corrected as shown below:

Column 17 con't.
Line 60, Claim 21, delete "propinate];" and insert -- propionate]; -- in place thereof.

Column 18
Line 6, Claim 22, delete "methypropanesulfonic" and insert
-- methylpropanesulfonic -- in place thereof.
Line 19, Claim 24, delete "subsize." and insert -- sub-size -- in place thereof.
Line 39, Claim 28, insert -- a -- following "having".

Column 19
Line 7, Claim 31, delete "free-radically" and insert -- free-radically -- in place thereof.
Line 14, Claim 32, delete "backing," and insert -- backing -- in place thereof.
Line 16, Claim 32, delete "subsize" and insert -- sub-size, -- in place thereof.

Signed and Sealed this

Twentieth Day of March, 2007

JON W. DUDAS
*Director of the United States Patent and Trademark Office*